US007009374B2

(12) United States Patent
Neaves

(10) Patent No.: US 7,009,374 B2
(45) Date of Patent: Mar. 7, 2006

(54) LOW RESISTANCE BANDGAP REFERENCE CIRCUIT WITH RESISTIVE T-NETWORK

(75) Inventor: Philip Neaves, Woking (GB)

(73) Assignee: Micron Technology Inc., Boise, ID (US)

( * ) Notice: Subject to any disclaimer, the term of this patent is extended or adjusted under 35 U.S.C. 154(b) by 21 days.

(21) Appl. No.: 10/804,346

(22) Filed: Mar. 19, 2004

(65) Prior Publication Data

US 2005/0052173 A1 Mar. 10, 2005

(30) Foreign Application Priority Data

Sep. 5, 2003 (GB) ..... 0320865

(51) Int. Cl.
*G05F 3/16* (2006.01)

(52) U.S. Cl. ..... 323/317; 323/316

(58) Field of Classification Search ..... 323/317, 323/316, 313, 314, 315; 327/539
See application file for complete search history.

(56) References Cited

U.S. PATENT DOCUMENTS 5,298,857 A * 3/1994 Voisine et al. ..... 324/142
6,242,974 B1 * 6/2001 Kunst ..... 330/9
6,531,857 B1 3/2003 Ju
6,570,437 B1 5/2003 Park et al.

OTHER PUBLICATIONS

Hironori Banba et al., A CMOS Bandgap Reference Circuit with Sub-1-V Operation, IEEE Journal of Solid-State Circuits, May 1999, 670-674, vol. 34, No. 5.
K. Lasanen, et al., Design of a 1-V Low Power CMOS Bandgap Reference Based on Resistive Subdivision available at website www.ee.oulu.fi/~Kimi/III-564.pdf on Aug. 11, 2003, 4 pgs.
F. Maloberti, Curvature Compensated Bicmos Bandgap with 1 V Supply Voltage available at website www.ewh.ieee.org/soc/cas/dallas/documents/MalobertiBGAP.pdf on Aug. 11, 2003, 29 pgs.
M. Waltari, et al., Reference Voltage Driver for Low-Voltage CMOS A/D Converters available at website www.ecdl.hut.fi/~mwa/publications/2000/ICECS00_1.pdf on Aug. 11, 2003, 4 pgs.

* cited by examiner

*Primary Examiner*—Shawn Riley
(74) *Attorney, Agent, or Firm*—Edward L. Pencoske

(57) ABSTRACT

A CMOS bandgap reference (BGR) voltage generator circuit has a passive resistor T-network of low resistance connected between the inverting and non-inverting inputs of the op-amp in the circuit. The op-amp's output is connected to the gates of three PMOS transistors and the drains of two of the transistors are connected in a looped manner to the input terminals of the op-amp. The T-network is placed between these drains that connect to the op-amp.

16 Claims, 5 Drawing Sheets

LOW RESISTANCE BANDGAP REFERENCE CIRCUIT WITH RESISTIVE T-NETWORK

BACKGROUND

1. Field of the Disclosure

The present disclosure generally relates to reference voltage generators and, more particularly, to a bandgap reference (BGR) voltage generator circuit with reduced substrate area.

2. Brief Description of Related Art

Reference voltage generators with a minimum (preferably zero) variation of output voltage with temperature are important elements for precise electronics. For example, an analog-to-digital converter (ADC) circuit may be fabricated on the same die with other digital systems increase the integration level. However, to maximize the usability of an ADC operating on sub 1-volt supply voltages, it is desirable to provide an on-chip low-voltage reference generator circuit that can provide a stable reference voltage to the ADC. Reference voltage generators are also used in DRAM's (dynamic random access memory), flash memories, and other analog or digital devices. The generators are required to be stabilized over process, voltage, and temperature variations, and also to be implemented without modification of fabrication process. The increased demand for portable electronic devices and the technology scaling are driving down the supply voltages of digital circuits. Low voltage operation and low power consumption are important design factors for battery-operated portable electronic devices. As CMOS (complementary metal oxide semiconductor) technologies continue to migrate into deep submicron region, the power supply voltage for devices produced using such CMOS technologies will likewise scale to below 1.5V for reliable operation of devices and also to keep the weights of the devices low.

Bandgap reference (BGR) voltage circuits are one of the most popular reference voltage generators that successfully achieves low-power, low-voltage operational demands. BGR circuits are used in bipolar, CMOS and bipolar CMOS (BICMOS) circuit designs for producing stable reference voltages for biasing other circuits on the chip, thereby allowing designs of battery-operated portable electronic devices. The stable reference voltages are used to control other voltage levels within a chip and to provide bias currents that are proportional to absolute temperature. For example, a bandgap reference voltage circuit in a cellular telephone must not only provide the required voltage regulation and bias current, but also must be power efficient because cellular telephones are powered by batteries. As bandgap reference circuits are integral to the majority of today's electronic devices, the reliability of the bandgap reference voltage circuit is essential to avoid device failures.

A conventional bandgap reference circuit is a circuit that subtracts the voltage ($V_{BE}$) of a forward-biased diode having a negative temperature coefficient from a voltage ($V_T$) proportional to absolute temperature (PTAT) and having a positive temperature coefficient. At room temperature, the temperature coefficient of $V_{BE}$ is −2.2 mV/° C., whereas the temperature coefficient of the thermal voltage $V_T$ is +0.086 mV/° C. A PTAT (i.e., $V_T$) can be realized by amplifying the voltage difference of two forward-biased base-emitter junctions. As a consequence, a temperature compensated voltage close to the material bandgap of silicon (~1.22V) results. Thus, the BGR circuit operates on the principle of compensating the negative temperature coefficient of $V_{BE}$ with the positive temperature coefficient of the thermal voltage $V_T$. A full compensation at room temperature is given by:

$$V_{BG} = V_{BE} + nV_T = V_{BE} + n\frac{kT}{q} \tag{1}$$

where "n" is equal to 25.6 (=2.2/0.086), "k" is Boltzmann's constant (=$1.38\times10^{-23}$ J/K), and "q" is electronic charge (=$1.6\times10^{-19}$ C).

Because the value of $V_{BE}$ at room temperature for low currents is close to 0.650V and $V_T$ at room temperature is 25.8 mV the value of $V_{BG}$ (from equation (1) above) is 1.26V. At this point, the temperature dependence of $V_{BG}$ becomes negligibly small. Such a value (=1.26V) is just slightly more than the silicon energy gap (~1.22V). Therefore, circuits achieving temperature compensation in the range of silicon bandgap are called BGR circuits. As noted before, the output voltage of convention BGR circuits is around 1.26V, which limits the low supply voltage (Vcc) operation. In other words, the operational or supply voltage cannot be lowered below approximately 1.25V, which limits the low-voltage design for the CMOS circuits. Hence, it is desirable to develop a BGR circuit that successfully operates with sub-1V supply voltages.

FIG. 1 illustrates a prior art bandgap reference voltage generator circuit 10 that can operate with sub-1V supply voltage. A detailed description of the circuit 10 along with simulation results is provided in "A CMOS Bandgap Reference Circuit with Sub-1-V Operation" by Banba et al., IEEE Journal of Solid-State Circuits, Vol. 34, No. 5 (May 1999) (hereinafter "Banba"), the description of which is incorporated herein in its entirety. The BGR circuit in FIG. 1 utilizes an operational amplifier 12 along with three PMOS (P-substrate MOS—a type of CMOS) transistors 14 (P1), 16 (P2) and 18 (P3). The source terminals 24, 30 and 36, of transistors P1, P2 and P3 respectively, are electrically connected to a supply voltage Vcc. The gate terminals 26, 32 and 38, of transistors P1, P2 and P3, respectively, are connected to the output 23 of the op-amp 12. The drain terminal 28 of transistor P1 is connected (not shown) to the inverting input 22 of the op-amp 12, thereby supplying voltage Va at input 22. The drain terminal 34 of transistor P2 is connected (not shown) to the non-inverting input 20 of the op-amp 12, thereby supplying voltage Vb at input 20. In other words, transistors P1, P2 and the op-amp 12 are connected in a looped manner. On the other hand, the drain terminal 40 of the transistor P3 is not connected to the op-amp 12, but, instead, functions as an output terminal from which the reference voltage (Vref) generated by the BGR circuit 10 can be obtained. The voltage "Vref" is the same as the voltage "$V_{BG}$" given in equation (1) above.

It is noted at the outset that the terms "connected" and "electrically connected" are used interchangeably herein. These terms also refer to, in an appropriate context, the condition of being "electrically held at" a given potential. For example, the phrase. "connected to a reference potential" refers to the state of being electrically held at the reference potential.

In the BGR circuit 10, a combination of resistor and diode networks (described later hereinbelow) connected to drains 28 and 34 maintain the op-amp input voltages Va and Vb at the same potential.

$$V_a = V_b \tag{2}$$

As shown in FIG. 1, a resistor 42 (R1) is connected between the drain 28 and a reference potential (or circuit ground); whereas, the anode of a diode 44 is connected to the drain 28 and the cathode of the diode 44 is connected to the reference potential. A resistor-diode network consisting of a resistor 46 (R3) in series with a parallel combination of N diodes 48 is connected between the drain 34 and the reference potential as shown in FIG. 1. It is noted here that for ease of discussion the same reference numeral "48" is used herein to refer to each diode in the N diodes. Another resistor 50 (R2) is connected between the drain 34 and the reference potential, and also in parallel to the resistor-diode network (of R3 and N parallel diodes) as shown in FIG. 1. One terminal of an output resistor 52 (R4) is connected to the drain 40 and the other terminal to the reference potential to provide the reference voltage Vref.

In the circuit 10 in FIG. 1, the resistance of R1 and R2 is the same and the currents I1, I2 and I3 have the same value also.

$$R_1=R_2 \tag{3}$$

$$I_1=I_2=I_3 \tag{4}$$

Therefore, the respective branch currents have equal value also.

$$I_{1a}=I_{2a},\ I_{1b}=I_{2b} \tag{5}$$

For the circuit 10 in FIG. 1, the voltage differential, dVf, which is the voltage difference between the forward voltage across diode 44 (Vf1) and the forward voltage across N (N=100 in one implementation in Banba) parallel diodes (Vf2) is given by:

$$dV_f=V_{f1}-V_{f2}=V_T.\ln(N) \tag{6}$$

Banba teaches that the output voltage of the BGR circuit 10 is given by:

$$V_{ref}=R_4\left(\frac{V_{f1}}{R_2}+\frac{dV_f}{R_3}\right) \tag{7}$$

Hence, Vref is determined by the resistance ratio of R2, R3 and R4, and is little influenced by the absolute values of the resistance. Further, in Banba's circuit 10, the transistors P1, P2 and P3 preferably operate in the saturation region so that their drain-to-source voltages can be small when the drain-to-source currents are reduced.

In an experimental analysis of the circuit 10, Banba provides the following values for various resistors in the circuit 10 to achieve a simulated Vcc of 0.84V: R1=R2=2 MΩ, R3=393 kΩ, and R4=884 kΩ. These resistor values provide low power consumption (i.e., current consumption in the range of tens of microamperes). Other resistor values may be selected to achieve results similar to those obtained in Banba. For example, in one implementation, the topology of the circuit 10 in FIG. 1 was fabricated on a silicon substrate using a typical 0.18 μm CMOS fabrication process, with the following resistor values to achieve results similar to those described in Banba: R1=R2=3.2 MΩ, R3=220 kΩ, and R4=800 kΩ. These resistor values were implemented with n-well (on p-substrate) and occupy significant area—the total area of the resistors was 300 μm×300 μm.

Thus, to fabricate a BGR circuit using Banba's circuit con figuration (i.e., the circuit 10 in FIG. 1) with sub 1V supply voltage operation and low power consumption, the substrate area occupied by the resistors in the circuit 10 is approximately 50% of the total silicon bandgap area. In other words, the area of the low voltage, low power bandgap proposed by Banba is dominated by the area of the very high value resistors employed in Banba—50% of the total cell size is due to the area of the resistors employed. Therefore, it is desirable to devise a BGR circuit configuration that achieves sub 1V operation and low power consumption while significantly reducing the chip real estate occupied by the resistors.

SUMMARY

In one embodiment, the present disclosure includes a bandgap reference (BGR) circuit that comprises an operational amplifier including a first input, a second input, and a first output; a T-network of passive resistors electrically connected between the first and the second inputs; and a transistor network having a third input and a second output, wherein the first output of the operational amplifier is electrically connected to the third input to generate a bandgap reference voltage at the second output. The T-network includes a first resistor having a first terminal and a second terminal, wherein the first terminal is electrically connected to the first input; a second resistor having a third terminal and a fourth terminal, wherein the third terminal is electrically connected to the second terminal and the fourth terminal is electrically connected to the second input; and a third resistor having a fifth terminal and a sixth terminal, wherein the fifth terminal is electrically connected to at least one of the second and the third terminals and the sixth terminal is electrically connected to a reference potential.

In another embodiment, the present disclosure contemplates an improvement in a bandgap reference circuit having an operational amplifier with a first input, a second input, and an output; a first CMOS transistor having a gate connected to the first output, a source connected to a supply voltage, and a drain connected to a diode, wherein the drain of the first CMOS transistor is configured to function as the first input; a second CMOS transistor having a gate connected to the first output, a source connected to the supply voltage, and a drain connected to a first resistor in series with a parallel network of diodes, wherein the drain of the second CMOS transistor is configured to function as the second input; a third CMOS transistor having a gate connected to the output, a source connected to the supply voltage, and a drain connected to a second resistor, wherein a bandgap reference voltage is obtained at the drain of the third CMOS transistor. The improvement comprises a T-network of passive resistors connected between the first and the second inputs, wherein the T-network includes a third resistor having a first terminal and a second terminal, wherein the first terminal is electrically connected to the first input; a fourth resistor having a third terminal and a fourth terminal, wherein the third terminal is electrically connected to the second terminal and the fourth terminal is electrically connected to the second input; and a fifth resistor having a fifth terminal and a sixth terminal, wherein the fifth terminal is electrically connected to at least one of the second and the third terminals and the sixth terminal is electrically connected to a reference potential.

In a still further embodiment, the present disclosure includes a method that comprises providing an operational amplifier having a first input, a second input, and a first output; connecting a T-network of passive resistors between the first and the second inputs; and further providing a transistor network having a third input and a second output, wherein the first output of the operational amplifier is connected to the third input. The T-network includes a first resistor having a first terminal and a second terminal, wherein the first terminal is connected to the first input; a second resistor having a third terminal and a fourth terminal, wherein the third terminal is connected to the second terminal and the fourth terminal is connected to the second input; and a third resistor having a fifth terminal and a sixth terminal, wherein the fifth terminal is connected to at least one of the second and the third terminals and the sixth terminal is connected to a reference potential.

In another embodiment, the present disclosure contemplates a method of generating a bandgap reference voltage. The method comprises using an operational amplifier having a first input, a second input, and a first output; using a T-network of passive resistors between the first a second terminal, wherein the first terminal is connected to the first input, a second resistor having a third terminal and a fourth terminal, wherein the third terminal is connected to the second terminal and the fourth terminal is connected to the second input, and a third resistor having a fifth terminal and a sixth terminal, wherein the fifth terminal is connected to at least one of the second and the third terminals and the sixth terminal is connected to a reference potential; further using a transistor network having a third input and a second output, wherein the first output of the operational amplifier is connected to the third input; and biasing the operational amplifier and the transistor network so as to generate the bandgap reference voltage at the second output.

The present BGR circuit includes a T-network in place of individual drain resistors. The overall resistance in the present circuit is substantially lower than the resistance in the prior art BGR circuit of comparable performance. Hence, the chip area occupied by the resistors in the circuit is substantially reduced when compared with the area occupied by the resistors in the prior art BGR circuit. The circuit provides a steady reference voltage with sub 1V supply and very low power consumption.

BRIEF DESCRIPTION OF THE DRAWINGS

For the present disclosure to be easily understood and readily practiced, the present disclosure will now be described for purposes of illustration and not limitation, in connection with the following figures, wherein.

DETAILED DESCRIPTION

Reference will now be made in detail to some embodiments of the present disclosure, examples of which are illustrated in the accompanying drawings. It is to be understood that the figures and descriptions of the present disclosure included herein illustrate and describe elements that are of particular relevance to the present disclosure, while eliminating, for the sake of clarity, other elements found in typical bandgap reference (BGR) voltage generator circuits.

Figure 1:
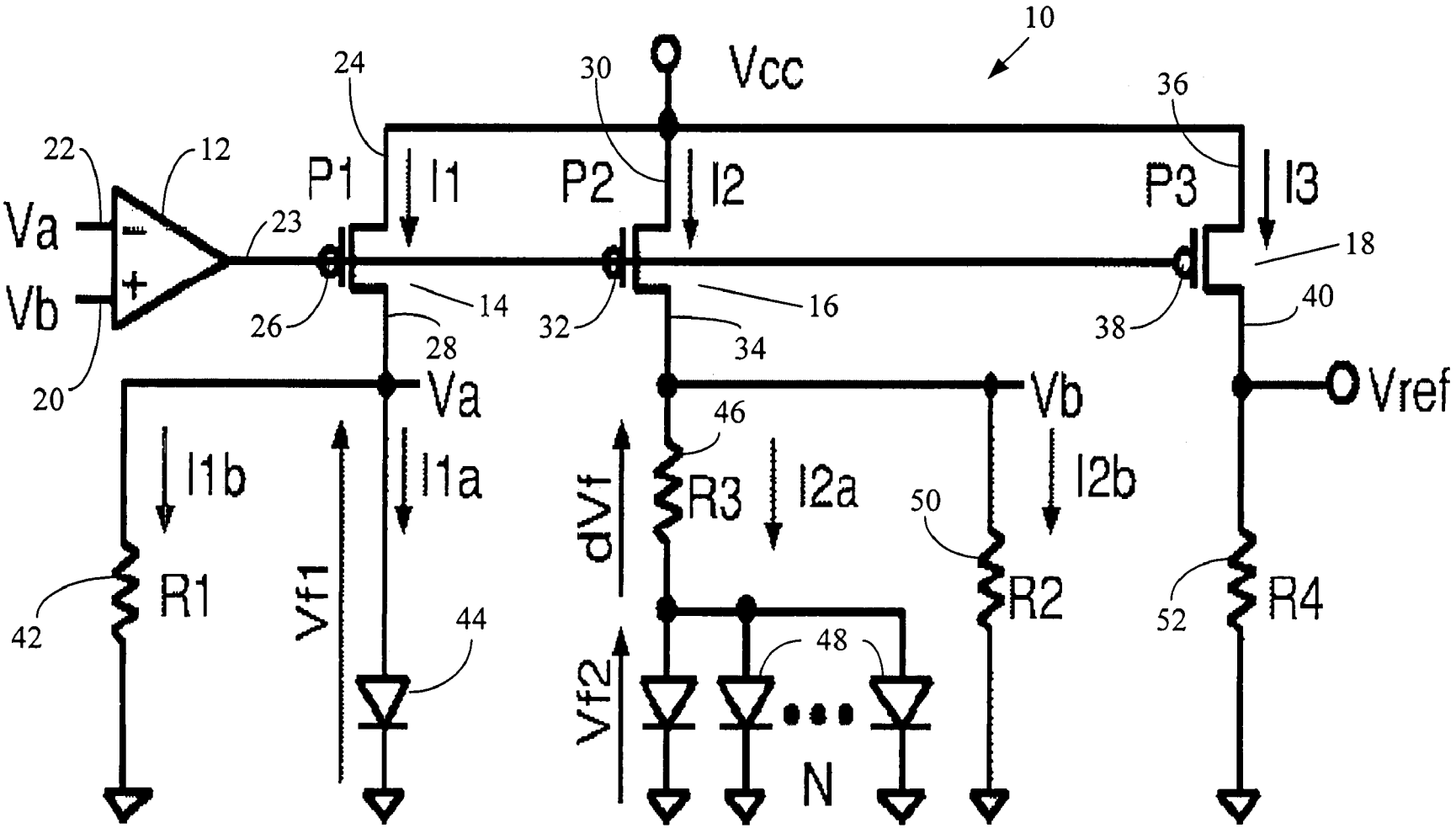
FIG. 1 (PRIOR ART)
FIG. 1 illustrates a prior art bandgap reference (BGR) voltage generator circuit that can operate with sub 1V supply voltage.
Figure 2:
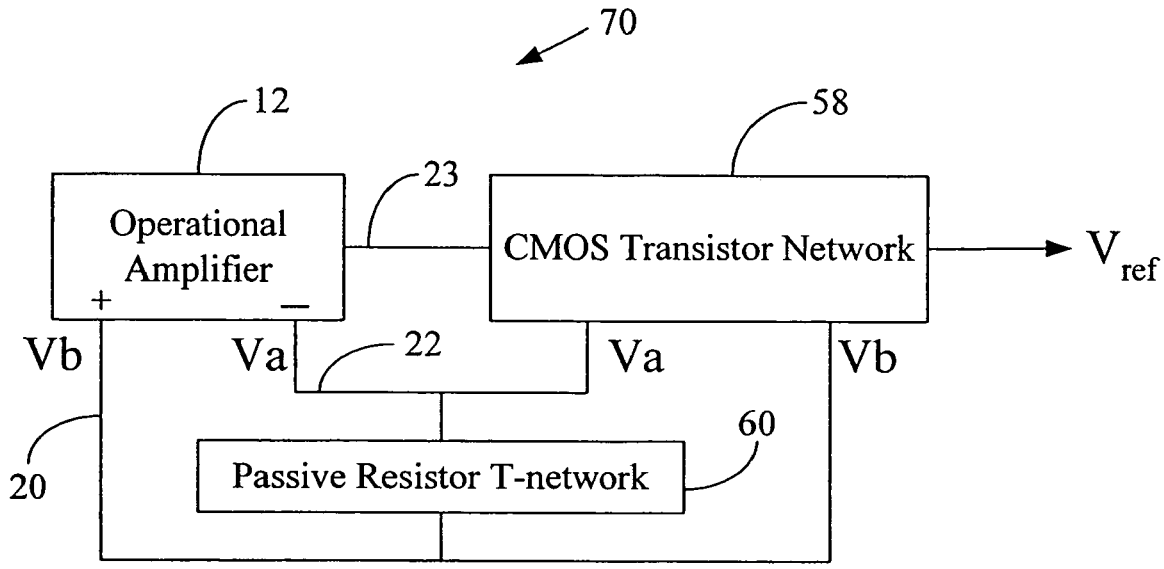
FIG. 2 is a block diagram representation of a BGR circuit according to one embodiment of the present disclosure.

FIG. 2 is a block diagram representation of a BGR circuit 70 according to one embodiment of the present disclosure. It is noted here that same reference numerals are used to identify elements common between the BGR circuit 70 and the circuit 10 in FIG. 1. For example, the op-amp 12 and its inputs 20, 22 are identical in the circuits in FIGS. 1 and 2 and, hence, are referred to by the same reference numerals. The BGR circuit 70 also includes a CMOS transistor network 58 (discussed in more detail hereinbelow with reference to FIG. 4) that is connected in a looped configuration to provide the input voltages, Va and Vb (Va=Vb), to the op-amp 12. A difference between the BGR circuit 10 in FIG. 1 and the circuit 70 in FIG. 2 is the presence of a passive resistor T-network 60 between the op-amp inputs 20, 22 as shown in FIG. 2.

Figure 3:
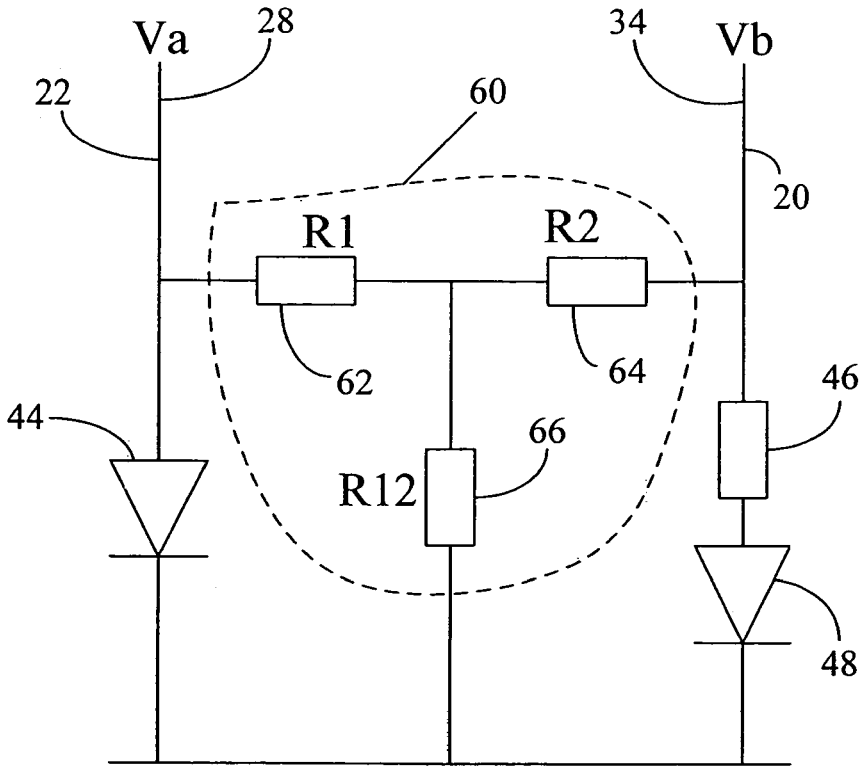
FIG. 3 depicts an exemplary passive resistor T-network according to the present disclosure implemented in a portion of the BGR circuit in FIG. 1.

FIG. 3 depicts an exemplary passive resistor T-network 60 according to the present disclosure implemented in a portion of the BGR circuit 10 in FIG. 1. The portion of the BGR circuit 10 shown in FIG. 3 includes the drain terminals 28 and 34 of transistors P1 and P2, respectively, and associated diode and resistor elements. The N parallel diodes in FIG. 1 are collectively represented by a single diode 48 in FIG. 3. The T-network 60 includes three passive resistors 62 (R1), 64 (R2), and 66 (R12) connected in a T-configuration between the op-amp inputs Va 22 and Vb 20 as illustrated in FIG. 3. Thus, the two original resistors 42 (R1) and 50 (R2) in the BGR circuit 10 in FIG. 1 are eliminated and the three-resistor T-network 60 is added. Both the resistors 62 and 64 are connected between the drain terminals 28, 34. Furthermore, in the configuration in FIG. 3, an additional resistor R12 (66) is connected from the junction of R1 (62) and R2 (64) to the reference potential. It is noted here that although passive resistors are shown as forming the T-network 60, in some embodiments of the present disclosure, one or more of the resistors in the T-network 60 may be active resistors (e.g., a resistor formed by a p-n junction) configured to provide resistance equal to that provided by the corresponding passive resistors.

Figure 4:
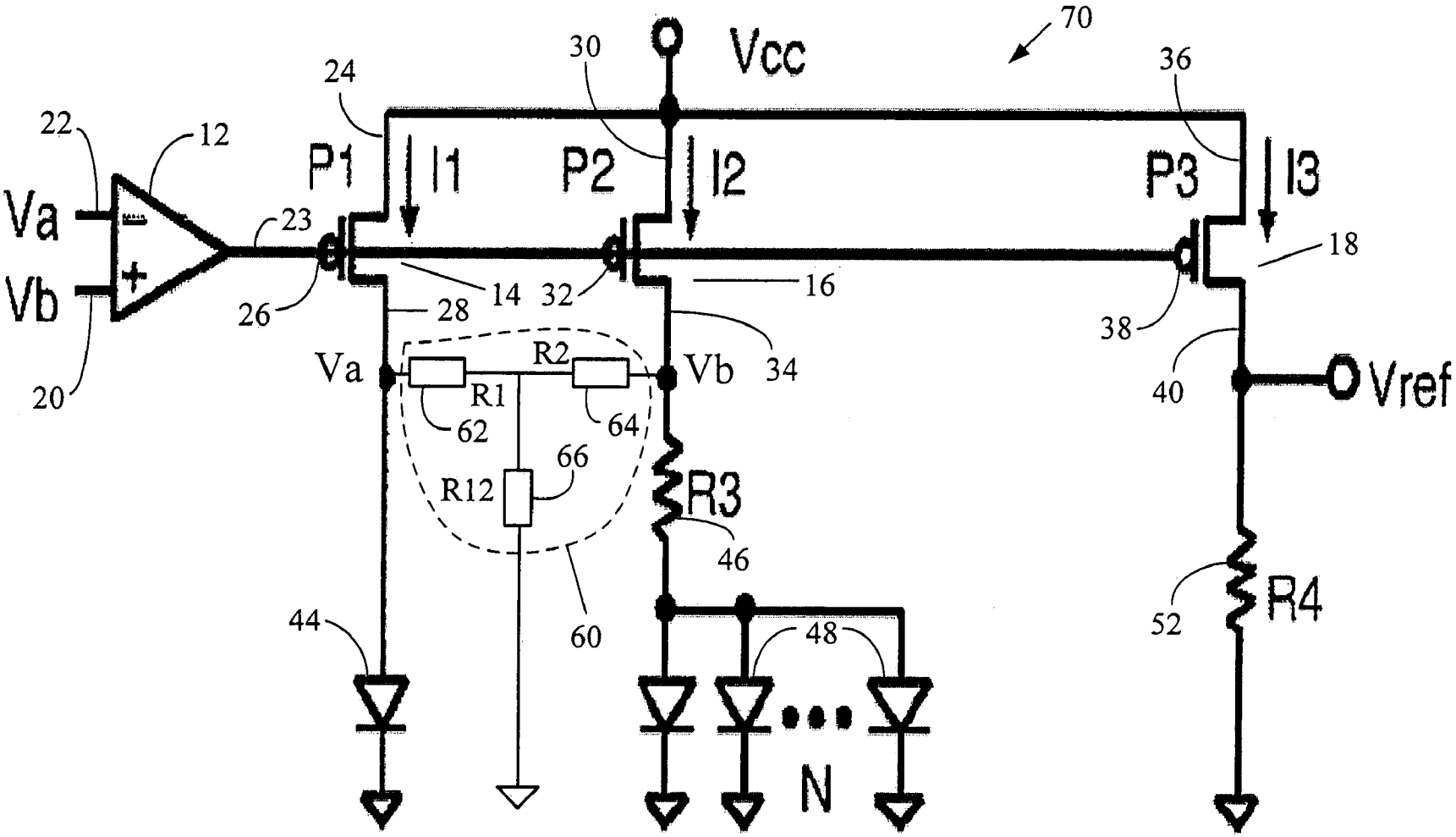
FIG. 4 shows the BGR circuit of FIG. 2 in more detail.

FIG. 4 shows the BGR circuit 70 of FIG. 2 in more detail. As can be seen from a comparison of the BGR circuits 10 and 70, the BGR circuit 70 is a modified form of the BGR circuit 10, with the passive resistor T-network 60 of FIG. 3 being added and the individual resistors R1 (42) and R2 (50) in FIG. 1 being eliminated as discussed hereinbefore. All other circuit elements in BGR circuits 10 and 70 remain identical and, therefore, the discussion of various circuit elements and their interconnection given hereinbefore under the "Background" section is not repeated here for the sake of brevity. As mentioned hereinbefore with reference to FIG. 2, the BGR circuit 70 includes a CMOS transistor network 58. The transistor network 58, as can be seen from FIG. 4, includes the three CMOS transistors P1 (14), P2 (16) and P3 (18). The transistor network 58 additionally may also include the diode 44 and N parallel diodes 48, and the resistors R3 (46) and R4 (52). All of the elements in the transistor network 58 are appropriately biased. Also, although not shown in FIGS. 1 and 4, it is understood that the op-amp 12 is also connected to appropriate supply and ground potentials. It is noted here that although the BGR circuit 70 is shown to include PMOS transistors, it is known in the art that a similar BGR circuit with appropriately biased NMOS (N-substrate MOS) transistors may also be constructed, instead of the PMOS transistor configuration of FIG. 4. Further, instead of using CMOS transistors 14, 16, 18, the BGR circuit 70 may also be constructed using dynamic-threshold MOS transistors (DTMOST), bipolar junction transistors, or BICMOS devices.

The BGR circuit 70 exploits the fact that because the op-amp inputs Va 22 and Vb 20 are at the same voltage, the two equal resistors R1 (42) and R2 (50) in FIG. 1 can be "shared" between the drain terminals 28 and 34, without modifying any other aspect of the circuit 10 in FIG. 1. This results in the new resistors R1 (62) and R2 (64), being significantly lower in resistance. Further, even if an additional resistor R12 (66) is added (thereby making the T configuration 60) to obtain the same performance as the sub-1V performance achieved by the BGR circuit 10 in FIG. 1, the combined overall value of all resistances in circuit 70 in FIG. 4 is still substantially lower than the total resistance present in the circuit configuration of FIG. 1. For example, as noted under the "Background" section hereinbefore, the resistors in the BGR circuit 10 in FIG. 1 may have the following values:

$$R1\ (42)=R2\ (50)=3.2\ M\Omega,\ R3\ (46)=220\ k\Omega,\ R4\ (52)=800\ k\Omega \tag{8}$$

In this event, the total resistance due to all these resistors in equation (8) is 7.42 MΩ. On the other hand, for substantially equal performance, the following resistor values may be assigned to the resistors in the BGR circuit 70 in FIG. 4:

$$R1\ (62)=R2\ (64)=100\ k\Omega,\ R12\ (66)=1.6\ M\Omega,\ R3\ (46)=220\ k\Omega,\ R4\ (52)=800\ k\Omega \tag{9}$$

The total resistance due to R1 (62), R2 (64), R12 (66), R3 (46) and R4 (52) in FIG. 4 with the values given in equation (9) is, however, only 2.82 MΩ. Hence, the bandgap in FIG. 4 provides substantially the same degree of performance as before (i.e., as in FIG. 1), but the area of the resistor network including resistors R1 (62), R2 (64), R12 (66), R3 (46) and R4 (52) is significantly reduced, because the area of resistors scales with their absolute values. For example, as discussed hereinbefore, the total area of resistors in FIG. 1 with resistance values given in equation (8) may be 300 μm×300 μm in one implementation of the circuit 10. However, in one embodiment, simulation of the BGR circuit 70 (for a typical 0.18 μm CMOS fabrication) with resistors R1 (62), R2 (64), R12 (66), R3 (46) and R4 (52) having values given in equation (9) results in the total chip area occupied by these resistors to be 185 μm×185 μm, which is an area reduction of 62% over the area (300 μm×300 μm) occupied by the resistors in the BGR circuit 10 for comparable performance. The reduction in area is achieved because lower valued resistors are employed as part of the T-network 60.

It is observed from equations (8) and (9) that the value of resistor R12 (66) may be half of the values of resistors R1 (42) and R2 (50). One reason for the reduction in value of R12 (66) is that when Va=Vb, $I_{1b}=I_{2b}$ (FIG. 1) as in equation (5) above. Therefore, the total current flowing through R12 (66) in the configuration of FIG. 4 is $I_{1b}+I_{2b}$ or $2I_{1b}$ (or $2I_{2b}$). Hence, R12 (66) can be half the value of either of R1 (42) or R2 (50). The additional resistors R1 (62) and R2 (64) are then needed to complete the T-network 60 in FIG. 4 to provide the performance comparable to that provided by the circuit 10 in FIG. 1. The values of these additional resistors R1 (62) and R2 (64) may be selected sufficiently high (e.g., 100 kΩ as in equation (9)) to provide some isolation between nodes Va and Vb in FIG. 4.

Figure 5:
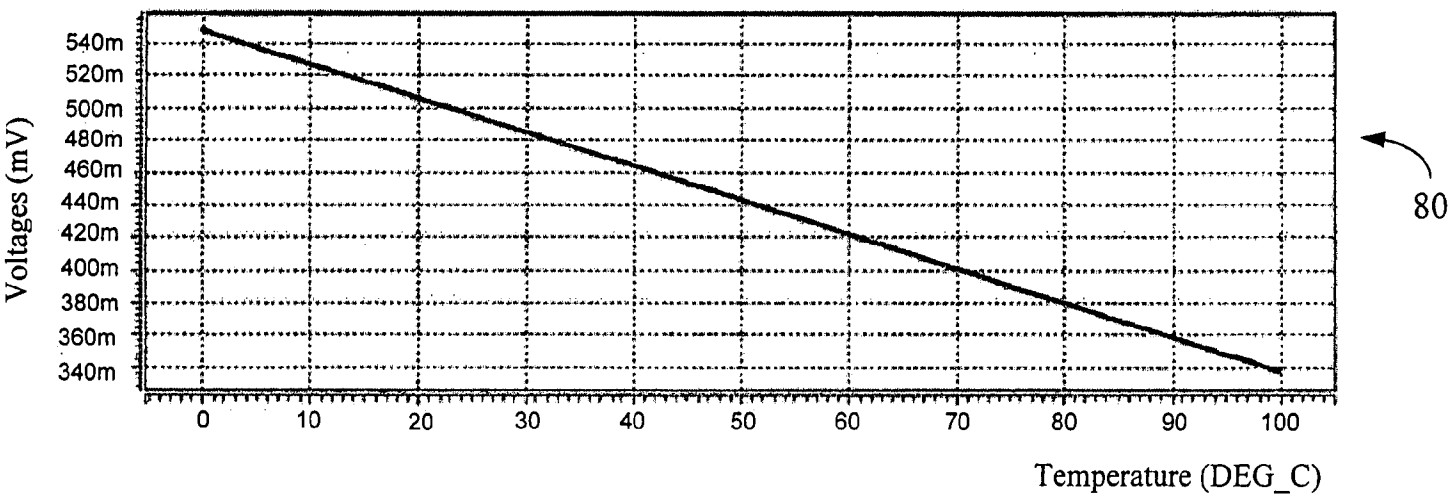
FIG. 5 illustrates a temperature graph of simulated values of Va and Vb in the circuit configuration shown in FIG. 4.
Figure 6:
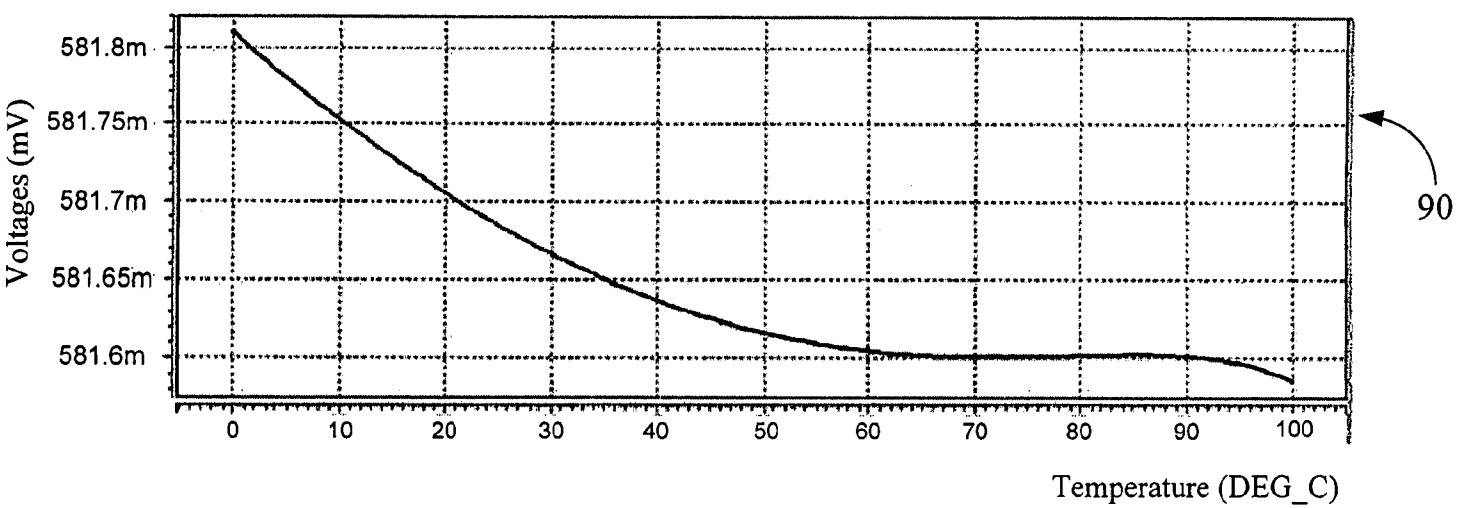
FIG. 6 is a temperature graph of simulated values of the reference voltage Vref generated using the circuit configuration shown in FIG. 4.

FIG. 5 illustrates a temperature graph 80 of simulated values of Va and Vb in the circuit configuration shown in FIG. 4. FIG. 6 is a temperature graph 90 of simulated values of the reference voltage Vref generated using the circuit configuration shown in FIG. 4. The BGR circuit 70 was simulated, using HSPICE software, with an "ideal" op-amp (for the op-amp 12) and with the resistor values given in equation (9) above. The number of parallel diodes 48 was one hundred (i.e., N=100). The simulation was performed using the TT models (typical n-type and p-type transistors) for a typical 0.18 μm CMOS fabrication process with Vcc=1.5V. Here, Va and Vb are proportional to absolute temperature (PTAT), and Vref is the desired reference voltage generated by the circuits 10, 70.

Figure 7:
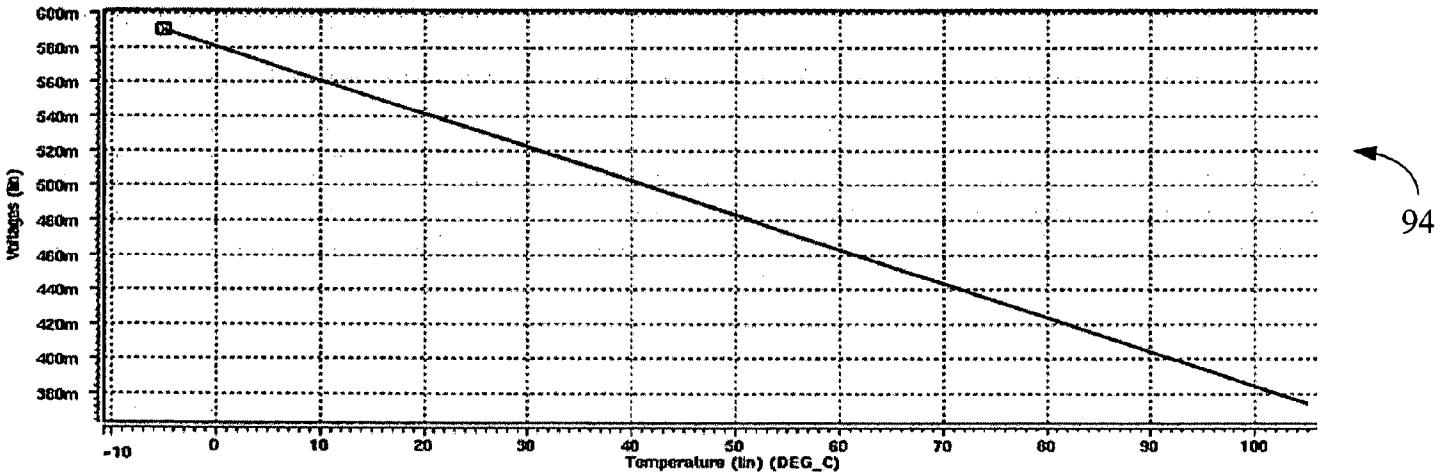
FIG. 7 illustrates a temperature graph of simulated values of Va and Vb in the circuit configuration shown in FIG. 1.
Figure 8:
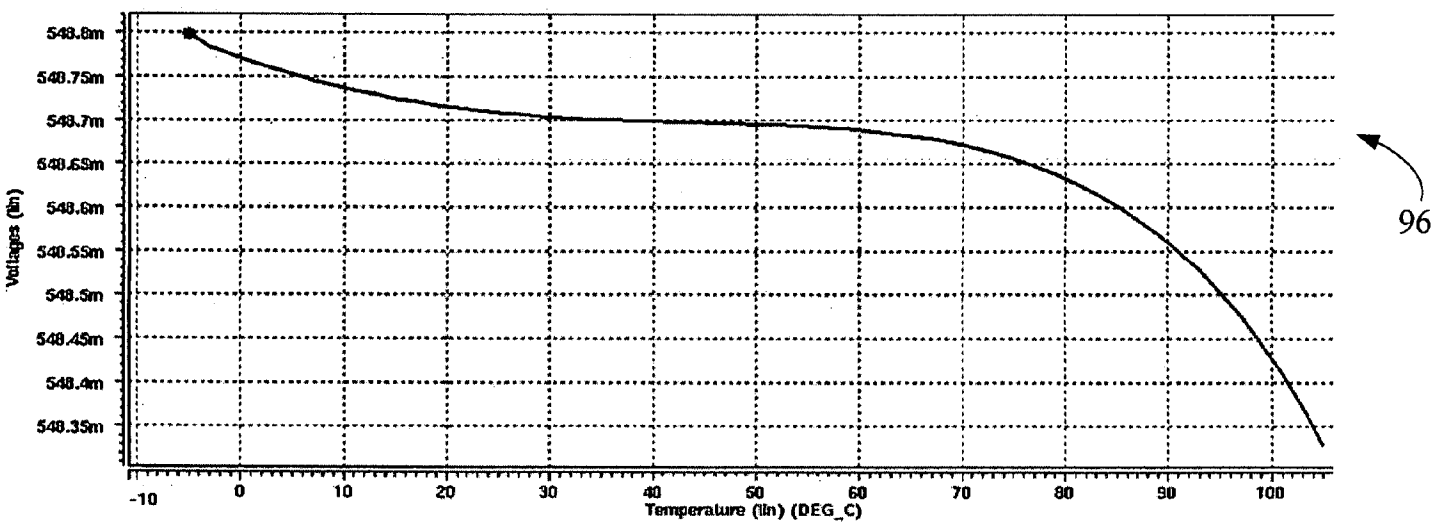
FIG. 8 is a temperature graph of simulated values of the reference voltage Vref generated using the circuit configuration shown in FIG. 1.

It is noted that the simulated values of Va and Vb (Va=Vb) in FIG. 5 against a range of temperature values, and the simulated values of Vref in FIG. 6 against a range of temperature values were consistent with the simulated values for Va, Vb and Vref obtained over the same temperature range in the BGR circuit 10 of FIG. 1, with the resistor values given in equation (8) above. For ease of comparison, FIG. 7 illustrates a temperature graph of simulated values of Va and Vb in the circuit configuration shown in FIG. 1, and FIG. 8 shows a temperature graph of simulated values of the reference voltage Vref generated using the circuit configuration shown in FIG. 1. Both of the circuits in FIGS. 1 and 4 were simulated using identical simulation conditions described hereinbefore (e.g., the same HSPICE simulation software, N=100 parallel diodes, TT models for transistors, etc.), except for the use of different resistor values—the values give in equation (8) for the simulation of the circuit in FIG. 1, and the values given in equation (9) for the simulation of the circuit in FIG. 4. It is observed that there is a slight shift (about 40 mV) in the graph in FIG. 8 for Vref as compared to the similar graph in FIG. 6. This shift may be attributable to the different resistor values "seen" by the diodes in FIG. 4 for resistors 62, 64, 66. However, the overall variation of Vref (in FIGS. 6 and 8) over a wide temperature range is significantly similar in the simulated results for circuits in FIGS. 1 and 4. Thus, it can be seen from the simulation results in FIGS. 5–8 that the BGR circuits 10 and 70 have comparable performance.

The foregoing describes a CMOS bandgap reference (BGR) voltage generator circuit with a passive resistor T-network of low resistance connected between the inverting and non-inverting inputs of the op-amp in the circuit. The op-amp's output is connected to the gates of three PMOS transistors and the drains of two of the transistors are connected in a looped manner to the input terminals of the op-amp. The T-network is placed between these drains that connect to the op-amp. The overall resistance in the present circuit is substantially lower than the resistance in the prior art BGR circuit of comparable performance. Hence, the chip area occupied by the resistors in the circuit is substantially reduced when compared with the area occupied by the resistors in the prior art BGR circuit. The present BGR circuit provides a steady reference voltage with sub-1V supply and very low power consumption. The BGR circuit according to the present disclosure, thus, can be used in chips with low power applications such as, for example, imaging sensors for digital cameras and mobile phones.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A bandgap reference circuit comprising:

an operational amplifier including a first input, a second input, and a first output;

a T-network of passive resistors electrically connected between said first and said second inputs, wherein said T-network includes:

a first resistor having a first terminal and a second terminal, wherein said first terminal is electrically connected to said first input, a second resistor having a third terminal and a fourth terminal, wherein said third terminal is electrically connected to said second terminal and said fourth terminal is electrically connected to said second input, and a third resistor having a fifth terminal and a sixth terminal, wherein said fifth terminal is electrically connected to at least one of said second and said third terminals and said sixth terminal is electrically connected to a reference potential; and a transistor network having a third input and a second output, wherein said first output of said operational amplifier is electrically connected to said third input to generate a bandgap reference voltage at said second output.

2. The bandgap reference circuit of claim 1, wherein said transistor network is a CMOS transistor network.

3. The bandgap reference circuit of claim 2, wherein said CMOS transistor network includes:

a first CMOS transistor having a gate electrically connected to said first output, a source electrically connected to a supply voltage, and a drain electrically connected to a diode, wherein said drain of said first CMOS transistor is configured to function as said first input;

a second CMOS transistor having a gate electrically connected to said first output, a source electrically connected to said supply voltage, and a drain electrically connected to a diode-resistor network, wherein said drain of said second CMOS transistor is configured to function as said second input; and a third CMOS transistor having a gate electrically connected to said first output, a source electrically connected to said supply voltage, and a drain electrically connected to a fourth resistor, wherein said drain of said third CMOS transistor is configured to function as said second output.

4. The bandgap reference circuit of claim 3, wherein each of said first, second, and third CMOS transistors is a P-substrate MOS.

5. The bandgap reference circuit of claim 3, wherein an anode of said diode is electrically connected to said drain of said first CMOS transistor and a cathode of said diode is electrically connected to said reference potential.

6. The bandgap reference circuit of claim 3, wherein said fourth resistor includes a seventh terminal and an eighth terminal, wherein said seventh terminal is electrically connected to said drain of said third CMOS transistor and said eighth terminal is electrically connected to said reference potential.

7. The bandgap reference circuit of claim 3, wherein said diode-resistor network includes:

a fifth resistor having a seventh terminal and an eighth terminal, wherein said seventh terminal is electrically connected to said drain of said second CMOS transistor; and one or more diodes electrically connected in parallel, wherein anodes of said one or more diodes are electrically connected to said eighth terminal and cathodes of said one or more diodes are electrically connected to said reference potential.

8. The bandgap reference circuit of claim 7, wherein said first resistor has a value of 100 kΩ, said second resistor has a value of 100 kΩ, said third resistor has a value of 1.6 MΩ, said fourth resistor has a value of 800 kΩ, and said fifth resistor has a value of 220 kΩ.

9. The bandgap reference circuit of claim 2, wherein said CMOS transistor network includes:

a first CMOS transistor having a gate connected to said first output and a source electrically connected to a supply voltage, wherein a drain of said first CMOS transistor is configured to function as said first input;

a diode having an anode and a cathode, wherein the drain of said first CMOS transistor is electrically connected to said anode and said reference potential is electrically connected to said cathode;

a second CMOS transistor having a gate electrically connected to said first output and a source electrically connected to said supply voltage, wherein a drain of said second CMOS transistor is configured to function as said second input;

a diode-resistor network including:

a fourth resistor having a seventh terminal and an eighth terminal, wherein said seventh terminal is electrically connected to the drain of said second CMOS transistor, and a plurality of diodes electrically connected in parallel, wherein anodes of said plurality of diodes are electrically connected to said eighth terminal and cathodes of said plurality of diodes are electrically connected to said reference potential;

a third CMOS transistor having a gate electrically connected to said first output and a source electrically connected to said supply voltage, wherein a drain of said third CMOS transistor is configured to function as said second output; and a fifth resistor having a ninth terminal and a tenth terminal, wherein said ninth terminal is electrically connected to the drain of said third CMOS transistor and said tenth terminal is electrically connected to said reference potential.

10. The bandgap reference circuit of claim 1, wherein said first input is an inverting input of said operational amplifier and said second input is a non-inverting input of said operational amplifier.

11. In a bandgap reference circuit having:

an operational amplifier including a first input, a second input, and an output;

a first CMOS transistor having a gate connected to said first output, a source connected to a supply voltage, and a drain connected to a diode, wherein said drain of said first CMOS transistor is configured to function as said first input;

a second CMOS transistor having a gate connected to said first output, a source connected to said supply voltage, and a drain connected to a first resistor in series with a parallel network of diodes, wherein said drain of said second CMOS transistor is configured to function as said second input;

a third CMOS transistor having a gate connected to said output, a source connected to said supply voltage, and a drain connected to a second resistor, wherein a bandgap reference voltage is obtained at said drain of said third CMOS transistor;

the improvement comprises:

a T-network of passive resistors connected between said first and said second inputs, wherein said T-network includes:

a third resistor having a first terminal and a second terminal, wherein said first terminal is electrically connected to said first input, a fourth resistor having a third terminal and a fourth terminal, wherein said third terminal is electrically connected to said second terminal and said fourth terminal is electrically connected to said second input, and a fifth resistor having a fifth terminal and a sixth terminal, wherein said fifth terminal is electrically connected to at least one of said second and said third terminals and said sixth terminal is electrically connected to a reference potential.

12. The improvement of claim 11, wherein said third resistor has a value of 100 kΩ, said fourth resistor has a value of 100 kΩ, and said fifth resistor has a value of 1.6 MΩ.

13. The improvement of claim 11, wherein said first input is an inverting input of said operational amplifier and said second input is a non-inverting input of said operational amplifier.

14. A method comprising:

providing an operational amplifier having a first input, a second input, and a first output;

connecting a T-network of passive resistors between said first and said second inputs, wherein said T-network includes:

a first resistor having a first terminal and a second terminal, wherein said first terminal is connected to said first input, a second resistor having a third terminal and a fourth terminal, wherein said third terminal is connected to said second terminal and said fourth terminal is connected to said second input, and a third resistor having a fifth terminal and a sixth terminal, wherein said fifth terminal is connected to at least one of said second and said third terminals and said sixth terminal is connected to a reference potential; and further providing a transistor network having a third input and a second output, wherein said first output of said operational amplifier is connected to said third input.

15. The method of claim 14, wherein further providing said transistor network includes:

providing a first CMOS transistor having a gate connected to said first output, a source connected to a supply voltage, and a drain connected to a diode, wherein said drain of said first CMOS transistor is configured to function as said first input;

providing a second CMOS transistor having a gate connected to said first output, a source connected to said supply voltage, and a drain connected to a diode-resistor network, wherein said drain of said second CMOS transistor is configured to function as said second input; and providing a third CMOS transistor having a gate connected to said first output, a source connected to said supply voltage, and a drain connected to a fourth resistor, wherein said drain of said third CMOS transistor is configured to function as said second output.

16. A method of generating a bandgap reference voltage, said method comprises:

using an operational amplifier having a first input, a second input, and a first output;

using a T-network of passive resistors between said first and said second inputs, wherein said T-network includes:

a first resistor having a first terminal and a second terminal, wherein said first terminal is connected to said first input, a second resistor having a third terminal and a fourth terminal, wherein said third terminal is connected to said second terminal and said fourth terminal is connected to said second input, and a third resistor having a fifth terminal and a sixth terminal, wherein said fifth terminal is connected to at least one of said second and said third terminals and said sixth terminal is connected to a reference potential;

further using a transistor network having a third input and a second output, wherein said first output of said operational amplifier is connected to said third input; and biasing said operational amplifier and said transistor network so as to generate said bandgap reference voltage at said second output.

* * * * *

UNITED STATES PATENT AND TRADEMARK OFFICE

CERTIFICATE OF CORRECTION

PATENT NO. : 7,009,374 B2
APPLICATION NO. : 10/804346
DATED : March 7, 2006
INVENTOR(S) : Philip Neaves It is certified that error appears in the above-identified patent and that said Letters Patent is hereby corrected as shown below:

Column 2, Line 59, delete “phrase.” and substitute therefore --phrase--.

Column 5, Line 16, after “first”, insert --and the second inputs, wherein the T-network includes a first resistor having a first terminal and--.

Signed and Sealed this

Thirteenth Day of May, 2008

JON W. DUDAS
*Director of the United States Patent and Trademark Office*